US007566382B2

(12) United States Patent
Hietaniemi

(10) Patent No.: US 7,566,382 B2
(45) Date of Patent: Jul. 28, 2009

(54) METHOD AND ARRANGEMENT FOR CONTROLLING SHORT CIRCULATION IN A PAPER MACHINE OR THE LIKE

(75) Inventor: Matti Hietaniemi, Tampere (FI)

(73) Assignee: Metso Automation OY, Helsinki (FI)

( * ) Notice: Subject to any disclaimer, the term of this patent is extended or adjusted under 35 U.S.C. 154(b) by 0 days.

(21) Appl. No.: 11/211,760

(22) Filed: Aug. 26, 2005

(65) Prior Publication Data

US 2005/0279477 A1 Dec. 22, 2005

Related U.S. Application Data

(63) Continuation of application No. 10/467,637, filed as application No. PCT/FI02/00147 on Feb. 22, 2002, now abandoned.

(30) Foreign Application Priority Data

Feb. 23, 2001 (FI) ..... 20010360

(51) Int. Cl.
*D21F 11/00* (2006.01)

(52) U.S. Cl. ..... 162/198; 162/190; 162/49; 162/263; 162/258; 700/127; 700/128; 73/53.04

(58) Field of Classification Search ..... 162/198, 162/263, 190, 258, DIG. 10, DIG. 11, 49; 700/127, 128, 129; 73/53.04, 863
See application file for complete search history.

(56) References Cited

U.S. PATENT DOCUMENTS 3,711,688 A 1/1973 Stout et al.
4,514,257 A 4/1985 Karlsson et al.
5,908,535 A * 6/1999 Fransson et al. ..... 162/198
6,328,851 B1 * 12/2001 Huhtelin et al. ..... 162/198
6,521,089 B1 * 2/2003 Griech et al. ..... 162/198
2002/0060017 A1 * 5/2002 Kuusisto et al. ..... 162/198
2003/0144747 A1 * 7/2003 Shakespeare ..... 700/28

FOREIGN PATENT DOCUMENTS

EP 0 062 620 A1 10/1982
WO WO 99/27182 6/1999

OTHER PUBLICATIONS

Mark Williamson; "Instruments, Controls Add Stability to Stora Port Hawkesbury Machine"; Dialog Information Services, File 15, ABI/Inform, Accession No. 01995683/9; Pulp & Paper vol. 74; No. 2; pp. 53-57; Feb. 2000.

* cited by examiner

*Primary Examiner*—Mark Halpern
(74) *Attorney, Agent, or Firm*—Oliff & Berridge, PLC

(57) ABSTRACT

A method and arrangement for controlling short circulation in a paper machine, in which the control of at least one property of the diluted fiber-containing pulp conducted to the headbox is based on consistency measurement or determination in high-consistency fiber-containing pulp, diluted pulp and/or white water. The amount of fiber-based fines in high-consistency fiber-based pulp, diluted fiber-based pulp and/or white water is determined, and the result obtained is used for controlling at least one property of the fiber-containing pulp to be conveyed to the headbox.

19 Claims, 6 Drawing Sheets

METHOD AND ARRANGEMENT FOR CONTROLLING SHORT CIRCULATION IN A PAPER MACHINE OR THE LIKE

This is a Continuation of application Ser. No. 10/467,637 filed Aug. 15, 2003, which in turn is a National Stage of PCT/FI02/00147 filed Feb. 22, 2002. The entire disclosures of the prior applications are hereby incorporated by reference herein in their entirety.

The present invention relates to a method and arrangement for controlling the short circulation in a paper machine or the like, as defined in the preambles of the independent claims presented below.

The short circulation in a paper machine includes especially the following stages:

(a) dilution with white water of the high-consistency fiber-containing pulp to be conveyed to the short circulation;
(b) feeding of the fiber-containing pulp diluted at stage (a) into the headbox and further onto the wire;
(c) separation of water from the diluted fiber-containing pulp fed onto the wire;
(d) conveying of the water separated at stage (c), the so-called white water, to stage (a), and
(e) control of at least one property of the diluted fiber-containing pulp to be conveyed to the headbox, the control being typically based on one or more determinations of the amount of solid matter in paper, high-consistency fiber-containing pulp, diluted fiber-containing pulp and/or white water.

The pulp fed from the headbox of a paper machine onto the wire contains, in addition to the actual fiber material consisting of long fibers, a large amount of other solids, such as fiber-based fines and filler.

Filler is added to the pulp to improve the properties of the paper, such as paper formation, surface properties, opacity, brightness and printability, and to lower the paper manufacturing costs. As a filler, various minerals can be used, such as kaolin, calcium carbonate, titanium oxide or talc.

The fiber-based fines originate from the virgin stock conveyed to the paper machine and from the broke pulp added to the virgin stock. The amount of fines varies due to variations in the process conditions or the quality of the fiber material fed. Variations in the amount of fiber-based fines in high-consistency stock chiefly derive from the disc filter, but changes in the composition of the broke added to the pulp and in the grinding of the virgin stock also have an effect. Fines refers to material that passes through a 200 mesh wire or that has a length of <1 mm, typically <0.2 mm.

In order to ensure that the filler particles and fiber-based fines do not flow with the water through the fiber network forming on the wire and through the wire itself, they are bound to the fiber material by means of retention aids, such as polyacrylamide. Because of this, the properties of the paper, such as the amount of filler and fiber-based fines in the paper, can be controlled by regulating the feed of retention aid.

The retention aid is fed into the diluted pulp being fed into the headbox typically in the vicinity of the machine screen, but it may also be fed elsewhere.

The conventional method for monitoring the wire retention of paper and board machines is based on sampling and laboratory determination of consistencies. This method is sufficiently accurate as such, but the procedure is time-consuming and rather laborious. Analyses are probably made at intervals of a few hours. Information obtained after several hours' delay does not provide the required information on the process status at a particular time. This type of monitoring does not, therefore, allow active control of the process.

Current wire retention monitoring is based on continuous on-line measurements and automatic control. Automatic retention control is in this case usually based on total consistency measurement made from the white water, that is, on measuring the total consistency of filler and fiber-based fines. The feed of the retention aid or an agent affecting retention is regulated on the basis of this consistency measurement. On the basis of the white water consistency measurement, a retention aid pump or valve is controlled to regulate the flow rate of retention aid to the desired level. This solution is based on the fact that the white water in a paper machine contains the major part of the poorly retainable components in the so-called short circulation of the paper machine's wet end. When the white water consistency is under control, the status of the short circulation is also under control.

Retention control has also been successfully combined with multivariable control, in which variations in ash can also be controlled. From international patent application WO 99/27182 it is known, for example, to adjust the properties of paper by controlling simultaneously the flow of the retention aid on the basis of the measurement of the variable describing the amount of filler in the white water, and the flow of filler on the basis of the measurement for the ash content of the paper and/or pulp. Since it has thereby also been possible to measure the ash content of the high-consistency pulp, it has been possible to combine the ash disturbances in the high-consistency pulp with filler feed regulation. The above-mentioned measurements and controls are, however, not always sufficient for retention control.

Patent publication EP 62620 discloses a method for measuring the amount of fiber-based fines. The pulp grinding process can be controlled on the basis of the measurement.

Control of retention or the amount of filler based on measurements made from the white water or paper is based on measurements that are incorporated in the process at too late a stage for faults in the machine to be corrected quickly before web formation.

When a fault occurs, for example, in pulp feed, resulting in a considerable change in the amount of fiber-based fines, this change in the circumstances will not show until after a delay of several minutes in the total consistency of the white water. The fault can thus only be corrected some time after the commencement of the fault. The change in the properties of the paper pulp caused by the fault cannot, therefore, be corrected before web formation. A fault in the amount of fines appears as changes, for example, in the retention, basis weight and moisture content of the paper.

The aim of the present invention is to provide an improved method and arrangement for controlling the short circulation in a paper machine or the like.

The aim is then also to provide a method and arrangement by means of which the required change in retention aid and/or filler feed in the short circulation can be predicted.

A further aim is to provide a method and arrangement that make possible multivariable control with improved retention and/or white water consistency control.

To achieve the foregoing aims, the method and arrangement according to the invention are characterised by what is defined in the characterising parts of the independent claims disclosed below.

The invention relates to an arrangement at the wet end of a paper machine or the like, in the short circulation of the machine, in which pulp diluted with white water from high-consistency fiber-containing pulp, so-called thick stock, is conveyed to the headbox, to which diluted pulp is typically added a retention aid, such as polyacrylamide or other agent affecting retention, for retaining the fiber-containing fines which are contained in the pulp, and other fines, typically a filler improving the properties of the pulp.

The process at the wet end and the properties of the diluted fiber-containing pulp to be conveyed to the headbox can be controlled in a known manner by control means based on consistency measurements or determinations performed in the paper, high-consistency fiber-containing pulp, diluted fiber-containing pulp and/or the white water.

In the solution according to the invention it is proposed that

- the amount of fiber-based fines in the high-consistency fiber-based pulp, diluted fiber-based pulp, and/or the white water be determined by direct measurement or other method of determining, and
- the result obtained from this determination be used for controlling the properties of the pulp to be conveyed to the headbox.

The solution according to the invention can, therefore, typically be applied in controlling the short circulation to control retention in such a way that

- the amount of fiber-based fines in the paper, high-consistency fiber-based pulp, diluted fiber-based pulp or white water is determined
  - by measurements of the amount of fiber-based fines,
  - by calculating from the total consistency and fiber consistency measurements obtained from the fiber-based material, or
  - by calculating from the total consistency, fiber consistency and filler consistency measurements, and
- the addition of an agent affecting retention, such as a retention aid, for example, polyacrylamide, starch or a filler, is controlled according to the determination obtained.

By measuring the amount of fiber-based fines in the high-consistency pulp, that is, before the dilution of the pulp with white water, it is possible to avoid the effects of the white water on the measurement and the true addition of fiber-based fines to the wet end circulation can be measured.

The invention can thus be applied in such a way that the amount of fiber-based fines to be retained is measured at such an early stage that there will be time to correct possible fault situations on the basis of the measurement, in other words, there will be time to control the retention aid or filler feed to correspond to the new situation before the fault reaches the headbox.

Thus it is possible to detect a change in the amount of fiber-based fines taking place in the pulp already before the wire pit and pulp dilution, and to anticipate the change to take place in the retention aid or filler feed. The change in the retention aid feed and/or filler feed is advantageously to take place at the point of time when the change in fiber-based fines in the pulp flow has proceeded to the retention aid or filler feed point.

In paper manufacture, the aim is to keep the basis weight of the pulp retained on the wire constant. The amount of fiber-based fines in the web affects the moisture content of the web and thus the runnability of the web. It would, therefore, often be desirable also to be able to keep the amount of fiber-based fines constant.

The control principle applied depends on how the consistency of the high-consistency pulp fed to the short circulation has been controlled before feeding.

The consistency of the high-consistency pulp may, for example, be controlled to be constant on the basis of the fiber fraction, that is, the fiber content, and disregarding the fiber-based fines. In such a case, the control is carried out using the type of consistency measurement that only takes into account fiber consistency. This type of measurement can be carried out, for example, by means of a blade consistency meter based on shear force. When the consistency of high-consistency pulp is controlled to be constant—in this case on the basis of the fiber fraction alone—the amount of fiber-based fines in the high-consistency pulp or diluted pulp can be measured in accordance with the invention and this result can be used for controlling the short circulation.

The consistency of high-consistency pulp may also be controlled to be constant on the basis of the total fiber fraction. In this case a consistency meter is used that takes into account the total fiber consistency, that is, the fiber consistency and the consistency of fiber-based fines. The total fiber consistency may be measured, for example, with a consistency meter based on microwaves.

On the other hand, the total fiber consistency of the high-consistency pulp can also be obtained by calculation, that is, by adding the measured amount of fiber-based fines to the reading given by the fiber consistency meter, whereby the result obtained can be used for consistency control.

If the consistency of the high-consistency pulp is controlled to be constant on the basis of the fiber fraction alone, that is, disregarding the fiber-based fines, and the measurement of the fiber-based fines according to the invention shows that the amount of fiber-based fines has increased, depending on the case, either

- the feeding of retention aid can be decreased so that the amount of fiber-based fines retained on the web remains constant, the excess fiber-based fines being conveyed to the white water, or
- the feeding of retention aid can be increased so that an increased amount of fines can be retained on the web. More filler is, however, also retained on the web at the same time, and thus the required control must be made at the filler feed.

If, on the contrary, the consistency of the high-consistency pulp is controlled to be constant on the basis of the total fiber fraction, that is, by taking into account the fiber-based fines, and the measurement of the fiber-based fines according to the invention shows that the share of fiber-based fines increases and the share of fibers decreases correspondingly, and if the aim is to keep the total fiber amount retained on the web constant, the feed of retention aid can be increased in the short circulation in such a way that a correspondingly greater amount of the more poorly retained fiber-based fines are retained on the web. No changes will take place in the white water with regard to the amount of fibers. The addition of retention aid and the increase in the amount of fiber-based fines increases the retention of filler, in which case filler feed should be temporarily reduced.

If so desired, the ash contained in the high-consistency pulp can in addition be taken into account in controlling the consistency of high-consistency pulp.

On the other hand, the invention also makes possible the control of white water consistency, whereby measurements of the amount of fiber-based fines to be retained, present in the white water, are utilised. The addition of an agent affecting retention and/or a filler or the like can then be controlled on the basis of the need indicated by the measurements.

In the arrangement according to the invention, the feed of retention aid can be linked with multivariable control, where the retention aid feed, filler feed, or feed of other similar agent is linked with the same control system. In such a case, other changes taking place in the process can also be taken into account in the feed of these substances. If necessary, it is then also possible to take into account separately in control the amount of fiber-based fines in both high-consistency pulp and white water.

The determination of fiber-based fines in white water may correspondingly be performed on the basis of the difference between the total consistency of the white water and ash consistency, which represents the amount of fiber-based fines in the white water.

The content of fiber-based fines can, on the other hand, also be measured by means of a separate meter, which measures fiber length distribution. The different fines shares can then be calculated and weighted in the control by the probability with which they will appear in the wire pit, whereby the particularly poorly retained fiber fraction would be taken into account best in control.

An increase in retention aid also increases the retention of filler. In order to keep the consistency of the white water constant, in at least some cases, the filler feed must be controlled at the same time in such a way that the filler feed is momentarily reduced to obtain suitable filler consistency in the short water circulation of the wet end.

By utilising the solution according to the invention, the properties of the diluted pulp can be controlled by regulating the amount of fiber-containing fines in the short circulation, for example, by separately adding fines fibers to the circulation. Fines fibers can be obtained, for example, from fiber recovery, white water purification, such as micro-flotation, etc.

By means of the control according to the invention, it is possible to stabilise the wet end of the paper machine and to give the operator the opportunity to control events at the wet end more efficiently. In this way, the runnability of the paper machine can be improved and breaks can be reduced and the time required for grade changes can be shortened. Furthermore, the uniformity of paper quality, such as basis weight and moisture content, can be improved.

The invention is described in greater detail in the following, with reference to the accompanying drawings, in which FIG. 1 shows diagrammatically a previously known solution for retention aid control at the wet end of a paper machine;

Figure 1:
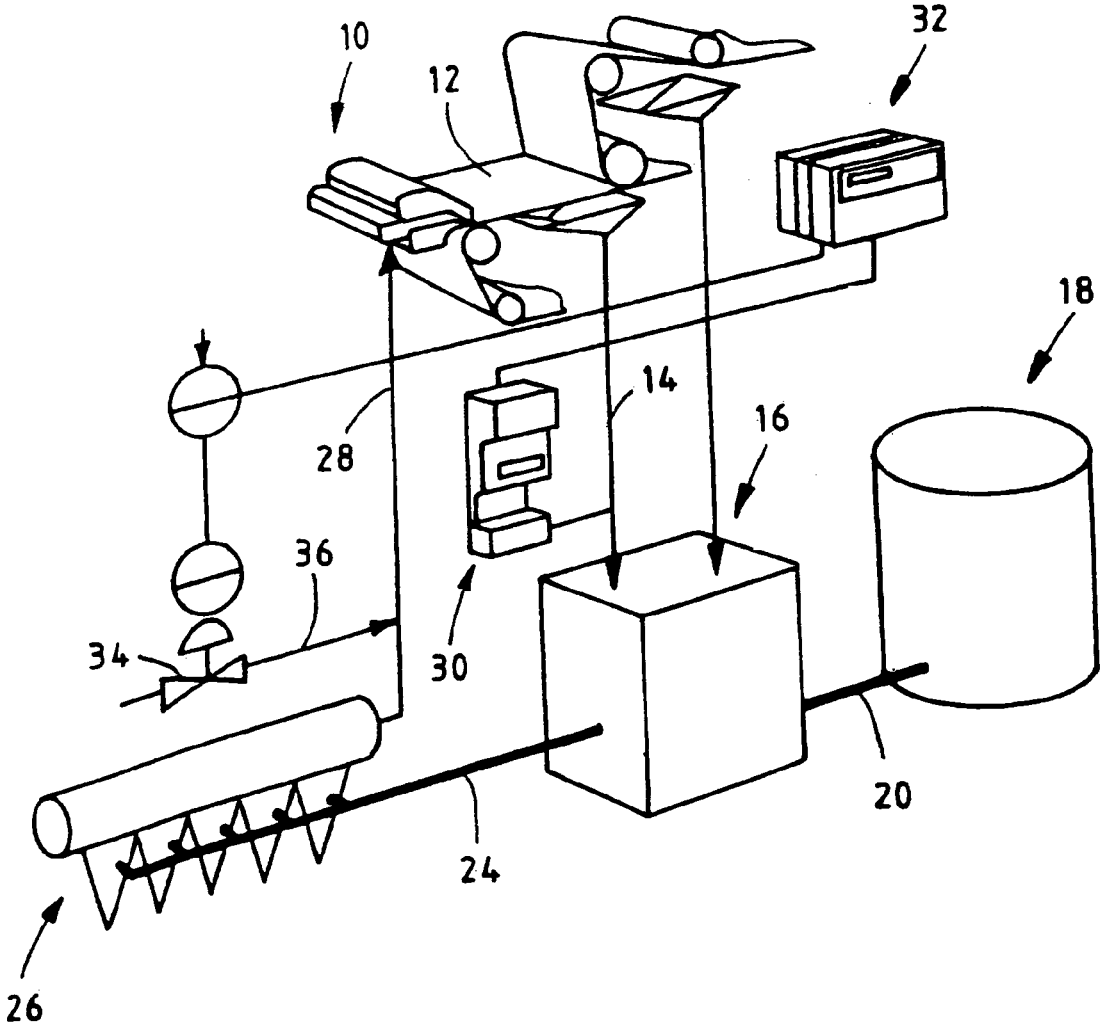
FIG. 1 PRIOR ART

FIG. 1 shows a part known as such of the pulp feed and white water system at the wet end of a paper machine, where the white water 14 removed from the fiber pulp fed onto the wire 12 from the headbox 10, which white water containing filler, fiber-based fines and retention aid, is conveyed to the wire pit 16. From the machine chest 18 to the wire pit is conveyed, along line 20, high-consistency pulp, so-called thick stock containing, among other things, virgin stock and broke pulp, which also contains fiber-based fines. In the wire pit, the high-consistency pulp is diluted with white water essentially to the consistency of the pulp fed to the headbox and conveyed as diluted pulp along line 24 to a centrifugal cleaner 26, from where the purified diluted pulp is conveyed along line 28 to the headbox 10.

The total consistency or ash consistency is measured from the white water by means of a measuring device 30. Ash consistency refers mainly to filler consistency. The amount of fiber-based fines is not measured separately. The measurement is transmitted to a control unit 32, which with a valve 34 regulates the feed 36 of retention aid to the diluted pulp line 28.

In case of a fault, for example, if the amount of fiber-based fines in the high-consistency pulp increases substantially, information on this change does not reach the meter 30, measuring the total consistency of the fines in the white water, until the excess fiber-based fines flow through the wire and the total consistency of the white water increases. The signal to the valve 34 regulating the addition of retention aid thus arrives only when pulp with properties not corresponding to the desired ones has already been fed to the wire for 1 to 2 minutes.

Figure 2:
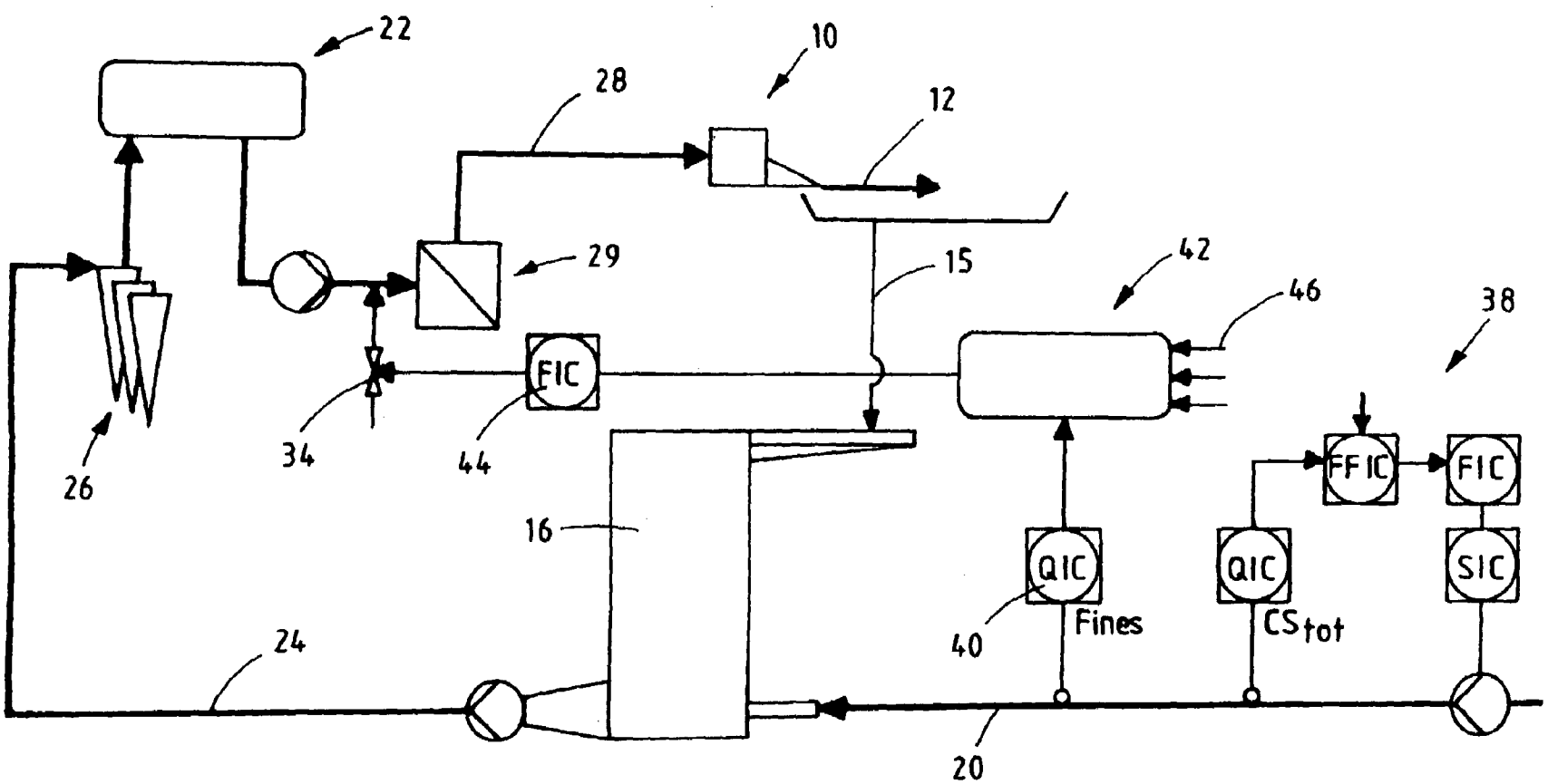
FIG. 2 shows diagrammatically the solution according to the invention for retention aid control at the wet end of a paper machine.

FIG. 2 shows a part of the pulp feed and white water system at the wet end of a paper machine applying the solution according to the invention. Where applicable, the same reference numerals are used in FIG. 2 as in FIG. 1. In the arrangement shown in FIG. 2, the white water removed from the pulp fed onto the wire 12 from the headbox 10, which white water contains filler and fiber-based fines that have separated from the pulp fed to the headbox and drained through the wire, is conveyed by means 15 to the wire pit 16, and from there, mixed with fiber pulp, further along diluted pulp line 24, through the centrifugal cleaners 26 and deaeration devices 22 by means of a pump to the machine screen 29, from which the finished paper pulp is conveyed along line 28 to the headbox 10.

High-consistency pulp, so-called thick stock, which typically contains both virgin stock and broke, is conveyed to the system from a machine chest (not shown) along line 20, to which is connected a feedforward solids flow measuring and control unit 38, known as such, which controls the flow of total solids so as to be constant. The purpose of the constant flow is to keep the total consistency constant in the diluted flow following the wire pit 16 in line 24.

In addition a measuring device 40 is connected to the high-consistency pulp line 20 for measuring the amount of fiber-based fines or the amount of total fines, which measuring device is connected according to the invention to a retention control unit 42 controlling the addition of retention aid by means of a flow rate controller 44 at control valve 34 to the diluted pulp to be conveyed to the machine screen 29 or elsewhere in the headbox.

In this way the retention aid feed can, in accordance with the invention, be maintained at such level that, of the pulp fed onto the wire, the desired total amount of fiber material, long fibers and fiber-based fines is retained on the wire, even when the ratio of the amounts of long and short fiber fractions to each other changes.

If so desired, it is possible to connect to the measuring device 40 measuring the amount of fines, a device which enables determination of the amount of different fiber fractions, for example, fibers of different lengths, in the pulp. The different fiber fractions can be given different weightings when determining the addition of retention aid.

From FIG. 2 it can be seen that other inputs 46 are also connected to the retention control unit 42, for taking into account other control parameters, such as the consistency of the white water, the set production values and the variables for multivariable control in retention control.

Figure 3:
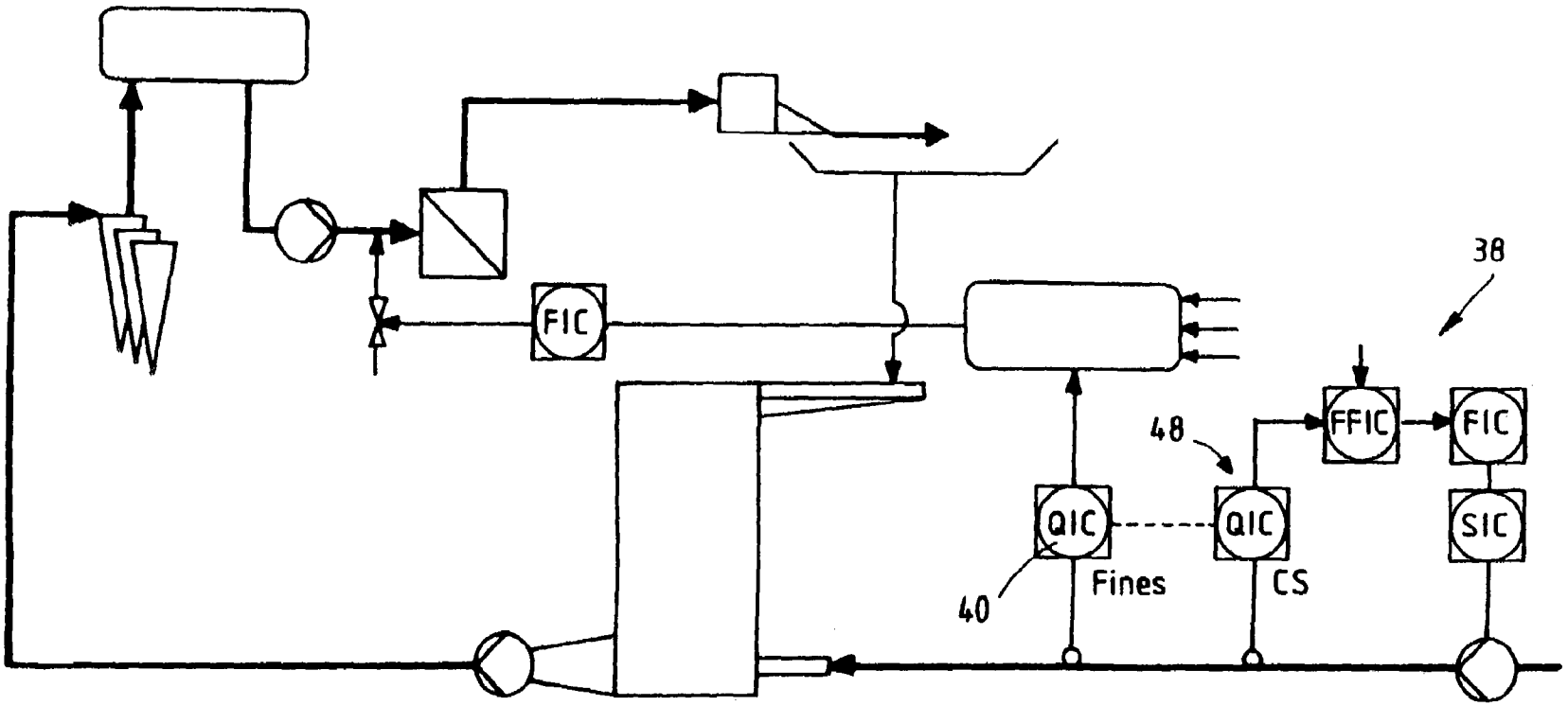
FIG. 3 shows, in accordance with FIG. 2, another solution according to the invention for retention aid control.

FIG. 3 shows an arrangement according to FIG. 2, using the same reference numerals where applicable. In FIG. 3, deviating from the arrangement of FIG. 2, only the consistency of the fiber fraction in the high-consistency pulp is measured by means of the consistency meter 48 in the solids flow measurement and control unit, and not the consistency of all solids. This measurement can be carried out by means of a blade consistency meter or other corresponding measuring device known as such, by which consistency is determined by means of the shear force.

The measuring device 48 measuring the consistency of the fiber fraction can be connected to a measuring device 40 measuring the amount of fiber-based fines, as shown by the broken line, whereby total fiber flow can be calculated. The retention aid feed is regulated in the manner shown in FIG. 2, based on measurement of the amount of fiber-based fines.

Figure 4:
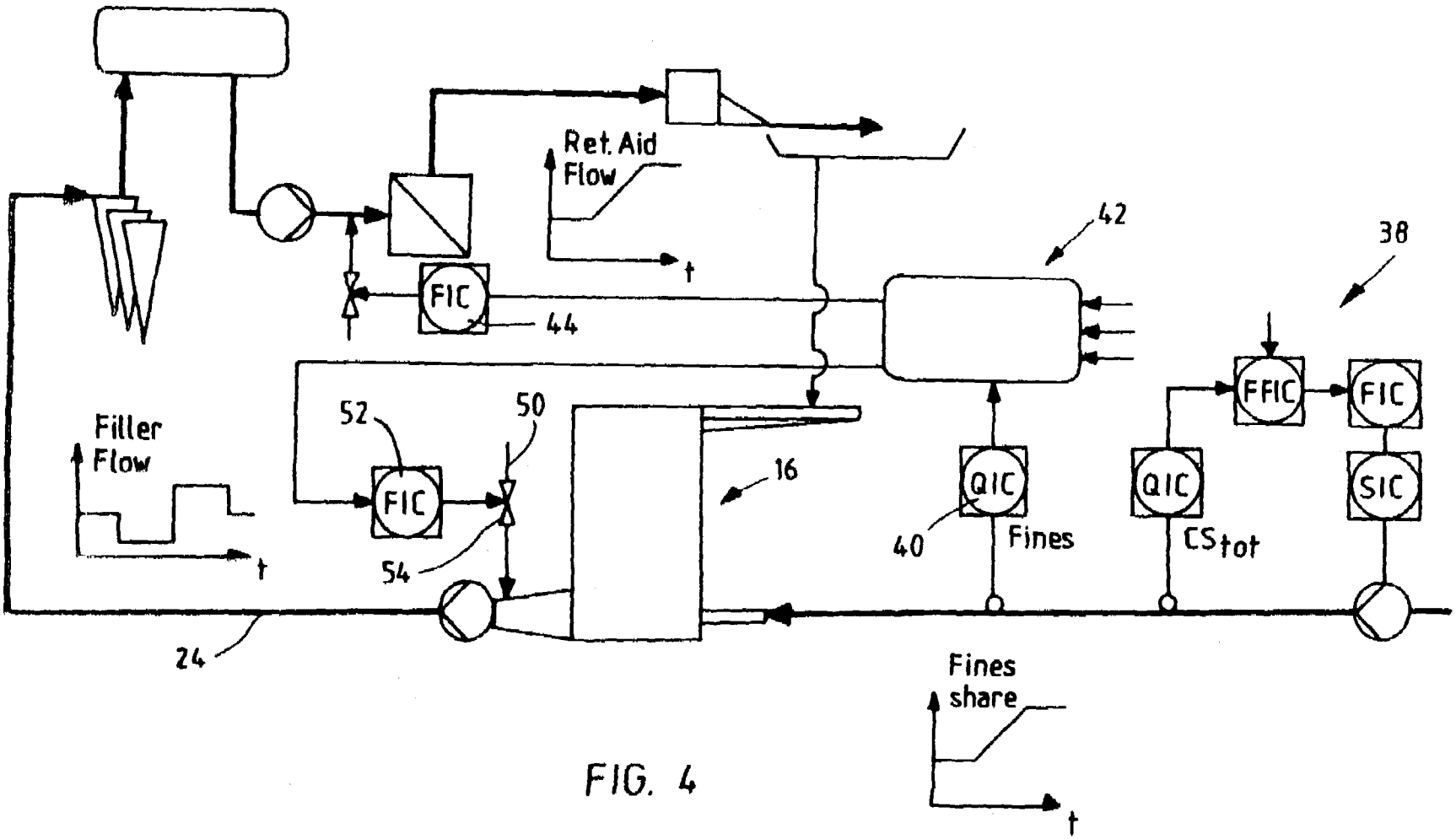
FIG. 4 shows, in accordance with FIG. 2, a solution according to the invention for simultaneously controlling retention and controlling filler feed.

FIG. 4 shows an arrangement according to FIG. 2, where filler feed control is connected to retention aid feed control 42, 44. In FIG. 4 the same reference numerals are used as in the previous Figures, where applicable.

In the arrangement shown in FIG. 4, filler is fed from the filler line 50 to the diluted pulp line 24 immediately after the wire pit 16. Filler feed is regulated by means of a constant flow valve 52, a valve 54, or a pump.

When, in the arrangement shown in FIG. 4, the total fiber consistency of the high-consistency pulp has been controlled to be constant by means of the control 38 according to FIG. 2, both the retention aid feed and the filler feed, that is, the ash in the paper, can be controlled on the basis of the fines measurement 40. When, for example, the amount of fiber-based fines in the high-consistency pulp increases, and the amount of long fibers in relation to fiber-based fines decreases, a greater amount of fines can be retained on the web by adding retention aid, and the total fiber flow from the wire section to the press section, that is, the long fibers and fiber-based fines, can be kept constant. By the addition of retention aid, a greater part of the fiber-based fines, of which there is now more and which is retained more poorly than the long fibers, can now be kept in the paper than before.

The addition of retention aid would, however, at the same time initially bind more filler to the paper than before, and due to the thus reduced amount of filler, less filler would remain in the water circulation of the wet end than before. To avoid such changes of filler in the paper, and to control the consistency of the white water to be suitable, preferably constant, in the arrangement according to the invention, the amount of filler added to the pulp can be controlled according to the respective situation.

In this way, in the case described above, where the increase in fiber-based fines requires an addition of retention aid, the addition of filler can simultaneously be momentarily reduced, in order not to retain too much filler in the paper at the start. When the amount of filler in the short circulation decreases, filler feed can be increased in order to reach a suitable balance in filler feed. In FIG. 4, the amounts of fiber-based fines, filler and retention aid on a time axis are shown by the "Fines share", "Filler flow" and Ret. Aid Flow" curves.

Figure 5:
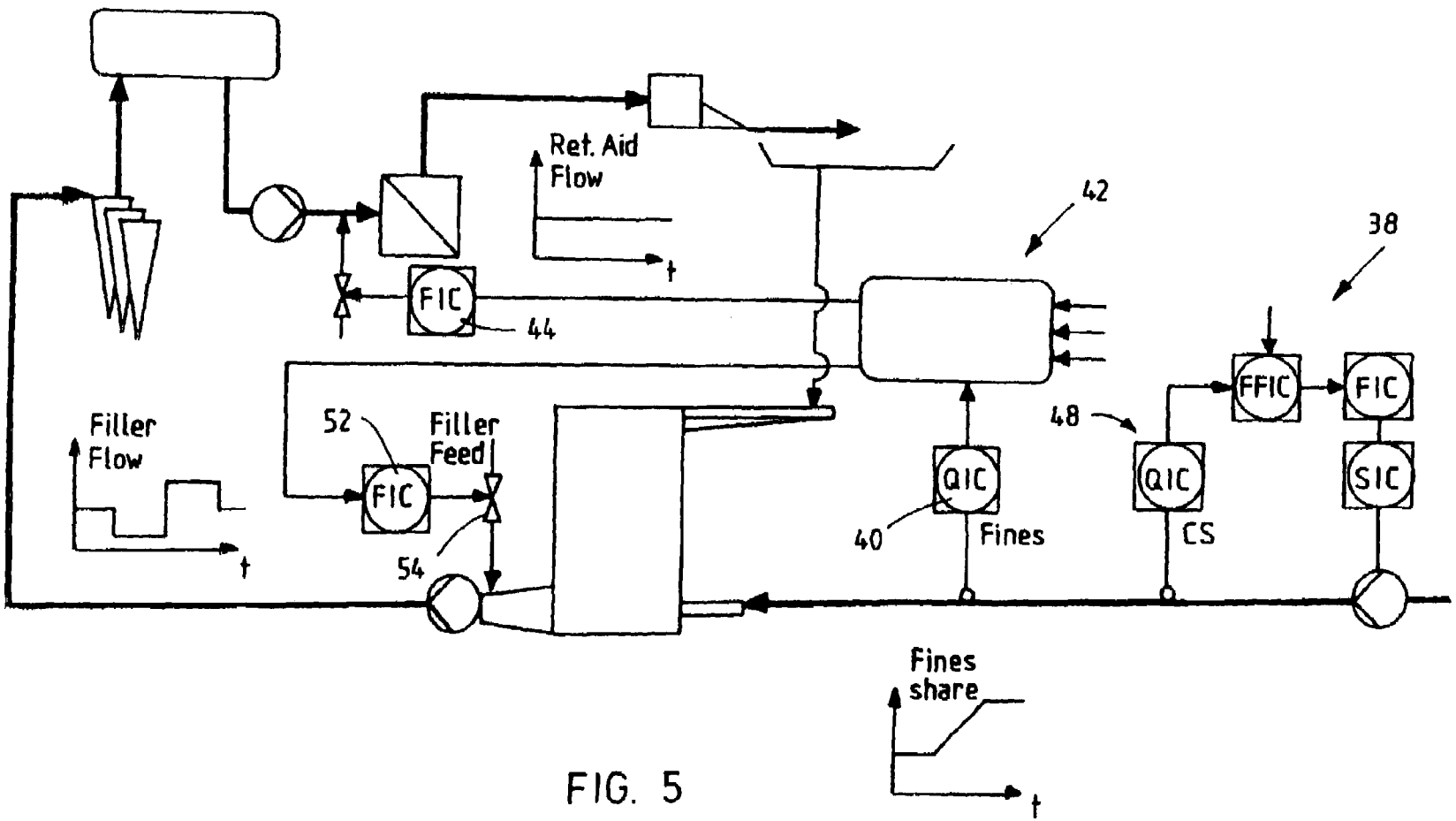
FIG. 5 shows, in accordance with FIG. 2, a solution according to the invention for controlling retention and filler feed.

FIG. 5 shows, in accordance with FIG. 4, another arrangement according to the invention for feeding retention aid and filler to the water circulation at the wet end of a paper machine. In FIG. 5 the same reference numerals are used as in FIG. 4, where applicable.

In FIG. 5, the high-consistency pulp fiber fraction is controlled to be constant by means of a control 38, using a blade consistency meter 48. The consistency of the diluted pulp is thus controlled to be constant on the basis of the fiber fraction, disregarding the fines. The fines content in the high-consistency pulp is measured by means of the measuring device 40.

In cases where the amount of fiber-based fines may be allowed to increase momentarily in the web, there is no need to add retention aid even though the amount of fiber-containing fines increases in the short circulation. However, the increased fiber-containing fines increase the retention of filler, and thus it may be necessary to momentarily reduce the filler feed until the amount of filler in the white water has decreased. In the case of FIG. 5, filler feed has been momentarily decreased by means of a control 52. After this measure, the filler balance in the short circulation is again returned.

Alternatively, in the case of FIG. 5, retention aid feed can be decreased by means of the control 42, 44, whereby the filler feed does not need to be changed.

Figure 6:
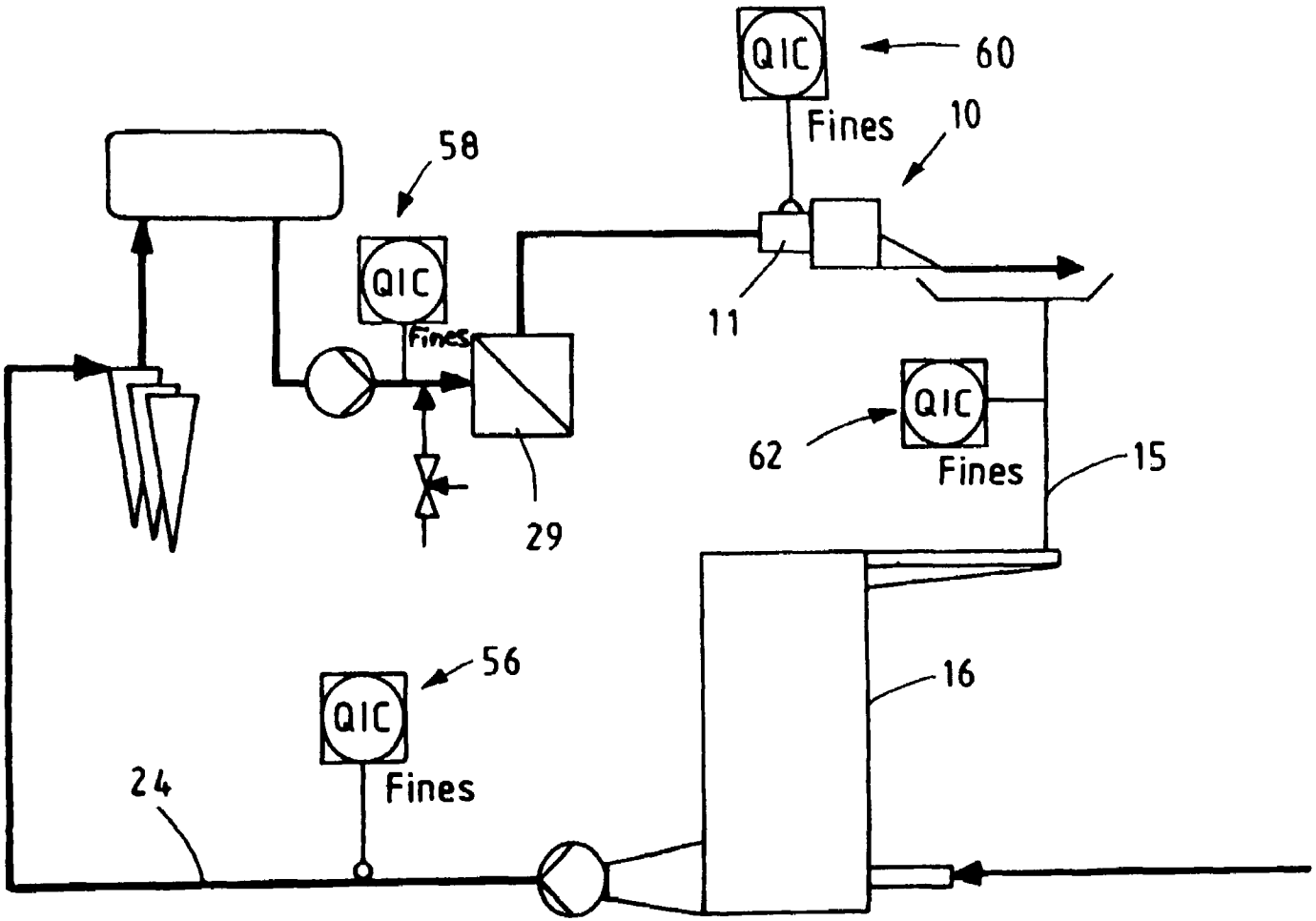
FIG. 6 shows, in accordance with FIG. 2, measuring devices for fiber-based fines fitted at the wet end of a paper machine.

FIG. 6 shows the short circulation of a paper machine according to FIG. 2, to which are fitted, by way of an example, measuring devices for fiber-based fines at different points. In the diluted pulp line 24, immediately after the wire pit, is fitted a measuring device 56. In front of the machine screen 29 is fitted a measuring device 58. In the bypass manifold 11 of the headbox 10 or its bypass circulation is fitted a measuring device 60. Also in the duct 15 leading from the wire to the wire pit 16 is fitted a measuring device 62. When applying the method according to the invention, the measuring devices for measuring the amount of fiber-based fines can be fitted at all such points in the short circulation, from which information is required on the consistency of the fines. The measuring devices are connected in a manner known as such to the desired control units.

The purpose is not to limit the invention to the embodiments described above by way of examples, but to apply the invention broadly within the scope of the inventive idea defined in the claims disclosed below.

The invention claimed is:

1. A method for controlling short circulation in a paper machine, the method comprising:

(a) diluting with white water of a high-consistency fiber-containing pulp to be conveyed to the short circulation;

(b) feeding the diluted high-consistency fiber-containing pulp diluted at stage (a) into a headbox and further onto a wire for manufacturing paper;

(c) separating white water from the diluted high-consistency fiber-containing pulp fed onto the wire;

(d) conveying the white water separated at stage (c) to stage (a), (e) determining an amount of fiber-based fines in the high-consistency fiber-containing pulp based on a consistency measurement carried out in the high-consistency fiber-containing pulp, and (f) controlling at least one property of the diluted high-consistency fiber-containing pulp to be conveyed to the headbox wherein the controlling is based on the determined amount of fiber-based fines in the high-consistency fiber-containing pulp.

2. The method as claimed in claim 1, the method further comprising: regulating, at stage (f), the amount of retention aid or other agent affecting retention fed to the diluted high-consistency fiber-containing pulp.

3. The method as claimed in claim 2, further comprising:

changing the addition of the retention aid or the agent affecting retention at that moment when a substantial change in the amount of fiber-based fines proceeds at the feed point of the retention aid or the agent affecting retention.

4. The method as claimed in claim 2, further comprising:

measuring the amount of filler in paper, the high-consistency fiber-containing pulp, the diluted high-consistency fiber-containing pulp or the white water, and regulating the addition of the retention aid or the agent affecting retention based on the measured amount of filler.

5. The method as claimed in claim 2, further comprising:

regulating, at stage (f), the amount of filler or other corresponding agent fed to the diluted high-consistency fiber-containing pulp and affecting the properties of the paper, such that the amount of filler or corresponding agent decreases as the amount of the retention aid or the agent affecting retention increases, or wherein the amount of filler or corresponding agent increases as the amount of the retention aid or the agent affecting retention decreases.

6. The method as claimed in claim 1, the method further comprising: regulating, at stage (f), the amount of filler or other corresponding agent fed to the diluted high-consistency fiber-containing pulp, for affecting the properties of the paper being manufactured.

7. The method as claimed in claim 6, further comprising;

changing the addition of the filler or the corresponding agent at that moment when a substantial change in the amount of fiber-based fines proceeds at the feed point of the filler or the corresponding agent.

8. The method as claimed in claim 1, further comprising:

regulating, at stage (f), addition of fiber-based fines into the high-consistency fiber-containing pulp, the diluted fiber-containing pulp or the white water.

9. The method as claimed in claim 1, further comprising:

keeping the total fiber consistency of the high-consistency fiber-containing pulp conveyed to the short circulation constant.

10. The method as claimed in claim 9, further comprising:

measuring the consistency of the fiber-based fines using a microwave-based consistency meter.

11. The method as claimed in claim 9, further comprising:

measuring the fiber consistency of the high-consistency fiber-containing pulp separately from the consistency of the fiber-based fines, and calculating the total fiber consistency of the high-consistency fiber-containing pulp on the basis of the fiber consistency of the high-consistency fiber-containing pulp and the consistency of the fiber-based fines.

12. The method as claimed in claim 11, further comprising:

measuring the fiber consistency of the high-consistency fiber-containing pulp by a measurement based on shear force.

13. The method as claimed in claim 9, further comprising:

controlling the total fiber consistency to be constant by means of a feedforward consistency control unit.

14. The method as claimed in claim 1, further comprising:

keeping the total consistency of the high-consistency fiber-containing pulp to be conveyed to the short circulation constant.

15. The method as claimed in claim 1, further comprising:

determining an amount of fiber-based fines in the white water, and controlling, at stage (f), said at least one property, wherein the controlling is also based on the determined amount of fiber-based fines in the white water.

16. The method as claimed in claim 15 , further comprising:

calculating the amount of fiber-based fines in the white water from the difference between the total consistency of the white water and the ash consistency of the white water, said difference representing the amount of fiber-based fines in the white water.

17. The method as claimed in claim 1, further comprising:

regulating at stage (f), the consistency of the white water.

18. A method for controlling short circulation in a paper machine, the method comprising:

(a) diluting with white water of a high-consistency fiber-containing pulp to be conveyed to the short circulation;

(b) feeding the diluted high-consistency fiber-containg pulp diluted at stage (a) into a headbox and further onto a wire for manufacturing paper;

(c) separating white water from the diluted high-consistency fiber-containing pulp fed onto the wire;

(d) conveying the white water separated at stage (c) to stage (a);

(e) determining an amount of fiber-based fines in the diluted high-consistency fiber-containing pulp or in the white water based on a consistency measurement or on a determination; and (f) controlling at least one property of the diluted high-consistency fiber-containing pulp to be conveyed to the headbox, wherein the controlling is based on the determined amount of fiber-based fines in the diluted high-consistency fiber-containing pulp or in the white water.

19. The method as claimed in claim 18, further comprising:

adding an agent affecting retention, filler, or other corresponding agent affecting the properties or runability of the paper being manufactured, to the diluted high-consistency fiber-containing pulp to be fed to the headbox; wherein, at stage (e)

determining the amount of fiber-based fines in the diluted fiber-containing pulp or the white water by one of:

measurements of the amount of fiber-based fines, calculating from total consistency and fiber consistency measurements for fiber-based material, and calculating from total consistency measurements, fiber consistency measurements and filler consistency measurements; and, at stage (f), controlling the addition of the agent affecting retention based on the determined amount of fiber-based fines in the diluted high-consistency fiber-containing pulp, or in the white water.

* * * * *